US008959854B1

(12) United States Patent
Bucklin

(10) Patent No.: US 8,959,854 B1
(45) Date of Patent: Feb. 24, 2015

(54) WEATHERPROOF FABRIC-COVERED BUILDING SYSTEM

(75) Inventor: Donald Orson Bucklin, Sisselton, SD (US)

(73) Assignee: Management Resources Group, LLC, Shawnee, KS (US)

( * ) Notice: Subject to any disclaimer, the term of this patent is extended or adjusted under 35 U.S.C. 154(b) by 10 days.

(21) Appl. No.: 13/115,159

(22) Filed: May 25, 2011

(51) Int. Cl.
*E04B 1/00* (2006.01)

(52) U.S. Cl.
USPC ..... 52/222; 52/395; 52/273; 52/81.3; 52/63; 160/380; 160/396

(58) Field of Classification Search
USPC ..... 52/222, 394, 395, 745.08, 407.3, 86, 52/81.3, 460, 63, 273; 296/107.11; 24/580.1, 462; 135/122, 129, 136, 97; 160/393, 396, 394, 397, 401, 380, 395; 403/381
See application file for complete search history.

(56) References Cited

U.S. PATENT DOCUMENTS

| | | | | | |
|---|---|---|---|---|---|
| 3,199,258 | A | * | 8/1965 | Jentoft et al. | 52/222 |
| 3,283,462 | A | | 11/1966 | Gregoire | |
| 3,791,076 | A | * | 2/1974 | Gahler | 52/2.17 |
| 3,875,623 | A | * | 4/1975 | Johnston | 24/580.1 |
| 3,930,344 | A | * | 1/1976 | Gahler | 52/2.17 |
| 3,953,955 | A | | 5/1976 | Huddle | |
| 3,987,835 | A | | 10/1976 | Bloomfield | |
| 4,184,294 | A | | 1/1980 | Purvis | |
| 4,214,407 | A | | 7/1980 | Charter | |
| 4,583,331 | A | * | 4/1986 | Hunt et al. | 52/2.17 |
| 4,665,670 | A | | 5/1987 | van den Burg | |
| 4,690,192 | A | * | 9/1987 | Stilling | 160/57 |
| 4,736,563 | A | * | 4/1988 | Bilhorn | 52/460 |
| 4,799,299 | A | * | 1/1989 | Campbell | 24/462 |
| 4,878,322 | A | * | 11/1989 | Ikeda et al. | 52/2.18 |
| 5,080,423 | A | * | 1/1992 | Merlot et al. | 296/105 |
| 5,094,043 | A | | 3/1992 | Ristow | |
| 5,242,004 | A | * | 9/1993 | Stilling | 160/57 |
| 5,269,106 | A | | 12/1993 | Stafford | |
| 5,333,425 | A | * | 8/1994 | Nickerson et al. | 52/222 |
| 5,784,842 | A | * | 7/1998 | Wackerbauer | 52/222 |
| 5,829,820 | A | * | 11/1998 | Cowsert | 296/107.11 |
| 5,953,875 | A | | 9/1999 | Harkins | |
| 6,026,613 | A | | 2/2000 | Quiring | |
| 6,564,513 | B2 | | 5/2003 | Henbid | |
| 6,668,495 | B1 | * | 12/2003 | Prince | 52/63 |
| 6,935,076 | B2 | | 8/2005 | Amir | |
| 7,127,851 | B2 | | 10/2006 | Morris | |
| 7,127,861 | B2 | | 10/2006 | Arbel | |
| 7,987,863 | B2 | * | 8/2011 | Warner | 135/97 |
| 8,336,236 | B2 | * | 12/2012 | Boltz et al. | 40/604 |
| 2007/0039250 | A1 | | 2/2007 | Morris | |
| 2007/0068958 | A1 | | 3/2007 | Besser | |
| 2009/0229646 | A1 | | 9/2009 | Whitlow | |
| 2010/0037544 | A1 | | 2/2010 | Musgrave | |

* cited by examiner

*Primary Examiner* — Chi Q Nguyen
(74) *Attorney, Agent, or Firm* — Neustel Law Offices

(57) ABSTRACT

A weatherproof fabric-covered building system for preventing water damage and leakage. The weatherproof fabric-covered building system generally includes a plurality of connecting members attached to a corresponding plurality of trusses, a plurality of fabric panels connected between the connecting members and a plurality of cap members connected to the connecting members to prevent water from entering the interior of the building structure.

19 Claims, 8 Drawing Sheets

WEATHERPROOF FABRIC-COVERED BUILDING SYSTEM

CROSS REFERENCE TO RELATED APPLICATIONS

Not applicable to this application.

STATEMENT REGARDING FEDERALLY SPONSORED RESEARCH OR DEVELOPMENT

Not applicable to this application.

BACKGROUND OF THE INVENTION

1. Field of the Invention

The present invention relates generally to a fabric-covered building and more specifically it relates to a weatherproof fabric-covered building system for preventing water damage and leakage.

2. Description of the Related Art

Any discussion of the related art throughout the specification should in no way be considered as an admission that such related art is widely known or forms part of common general knowledge in the field.

Fabric-covered buildings have been in use for years. An increasingly popular type of fabric-covered building is comprised of a plurality of arched trusses, a corresponding plurality of connecting members each having opposing side keder channels, wherein the connecting members are fastened to the trusses with conventional fasteners, and a plurality of fabric panels each having opposing keders that fit within the keder channels of the connecting members.

One of the problems with the keder type fabric-covered buildings is that water from rain, snow and ice-melt is able to make contact with the conventional fasteners that secure the connecting members to the trusses thereby resulting in undesirable corrosion of the fasteners. In addition, the water is able to seep around the fasteners and into the interior of the fabric-covered building which is undesirable particularly if the goods being stored is comprised of a perishable product such as but not limited to grain.

Because of the inherent problems with the related art, there is a need for a new and improved weatherproof fabric-covered building system for protecting the contents thereof from water leakage.

BRIEF SUMMARY OF THE INVENTION

The invention generally relates to a fabric-covered building for preventing water damage and leakage which includes a plurality of connecting members attached to a corresponding plurality of trusses, a plurality of fabric panels connected between the connecting members and a plurality of cap members connected to the connecting members to prevent water from entering the interior of the building structure.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

Figure 1:
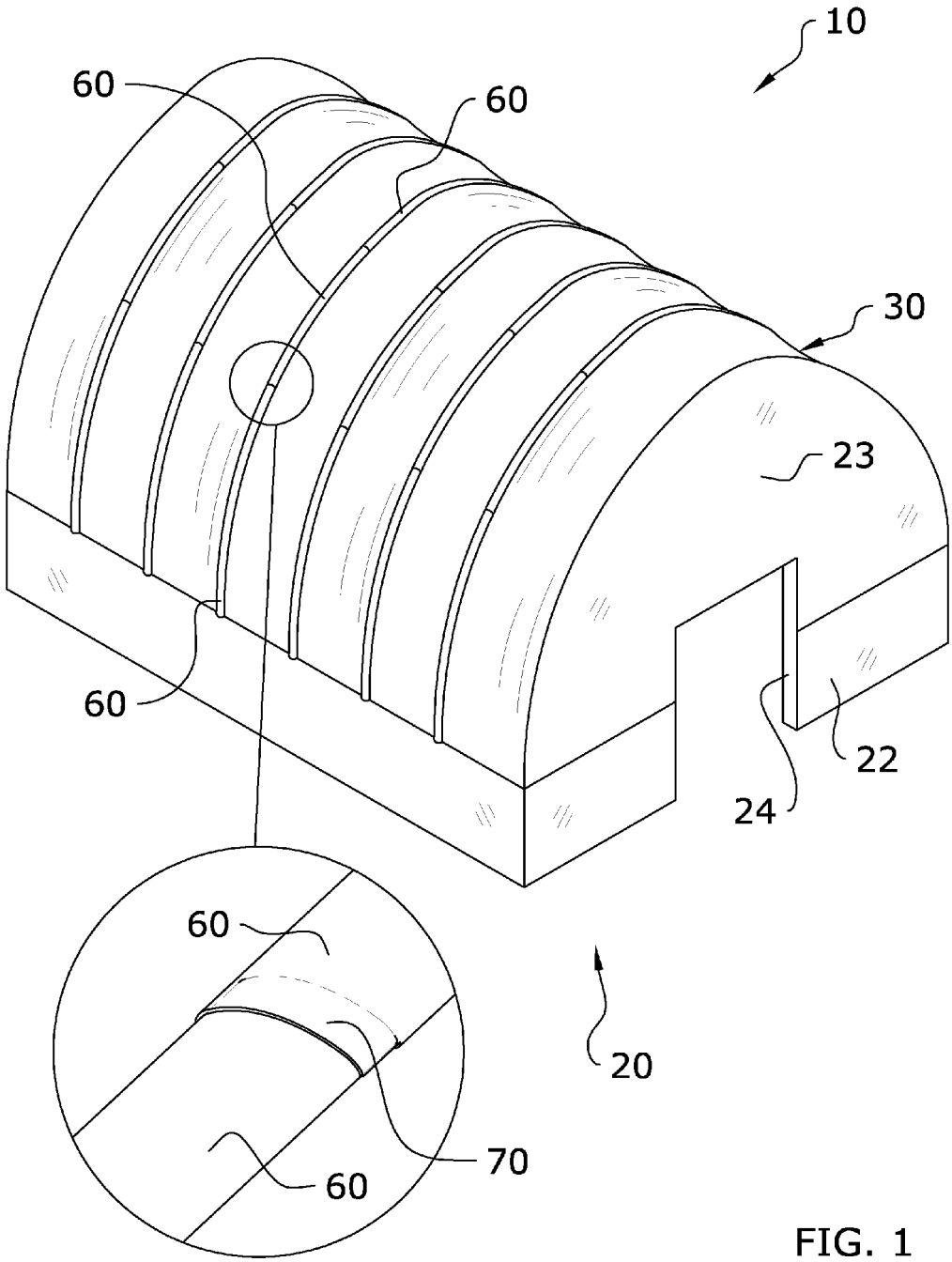
FIG. 1 is an upper perspective view of a storage building utilizing the present invention.

A. Overview.

Turning now descriptively to the drawings, in which similar reference characters denote similar elements throughout the several views, FIGS. 1 through 8 illustrate a weatherproof fabric-covered building system, which comprises a plurality of connecting members 40 attached to a corresponding plurality of trusses 36, a plurality of fabric panels 32 connected between the connecting members 40 and a plurality of cap members 60 connected to the connecting members 40 to prevent water from entering the interior of the building structure.

B. Trusses.

Figure 6:
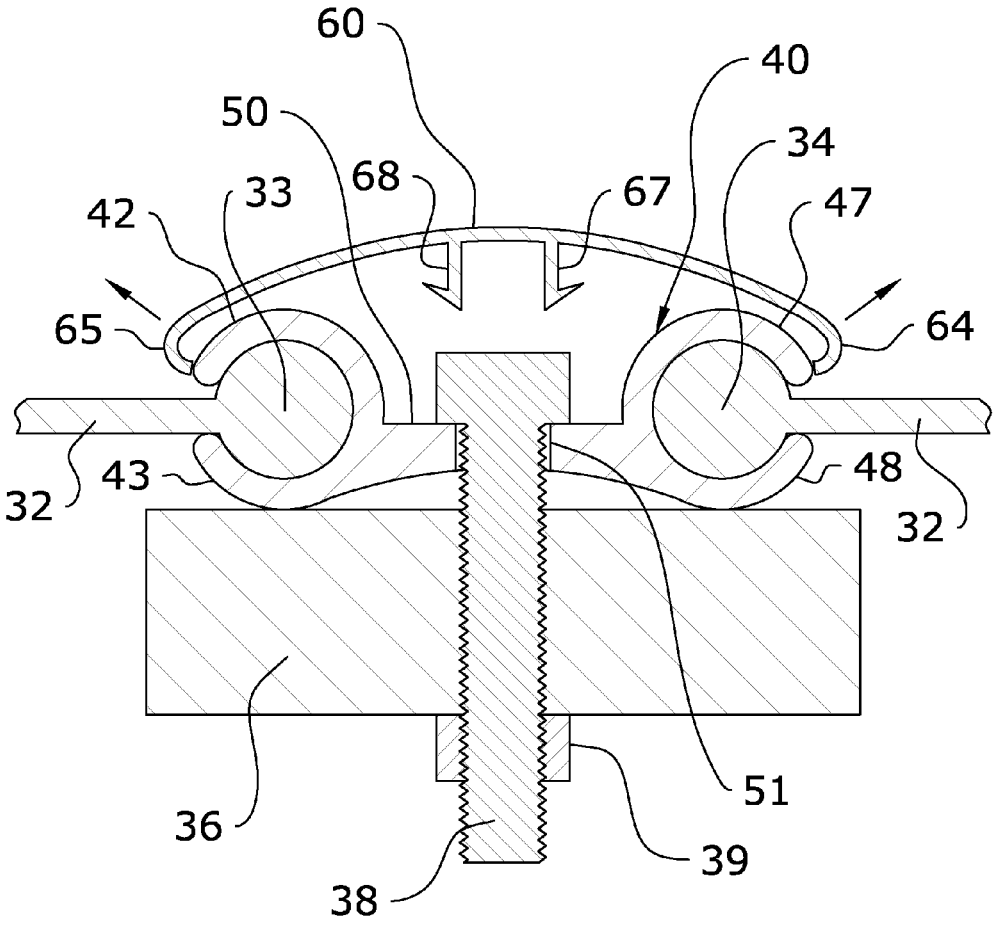
FIG. 6 is a sectional view of the covering strip being attached to the connector strip.
Figure 7:
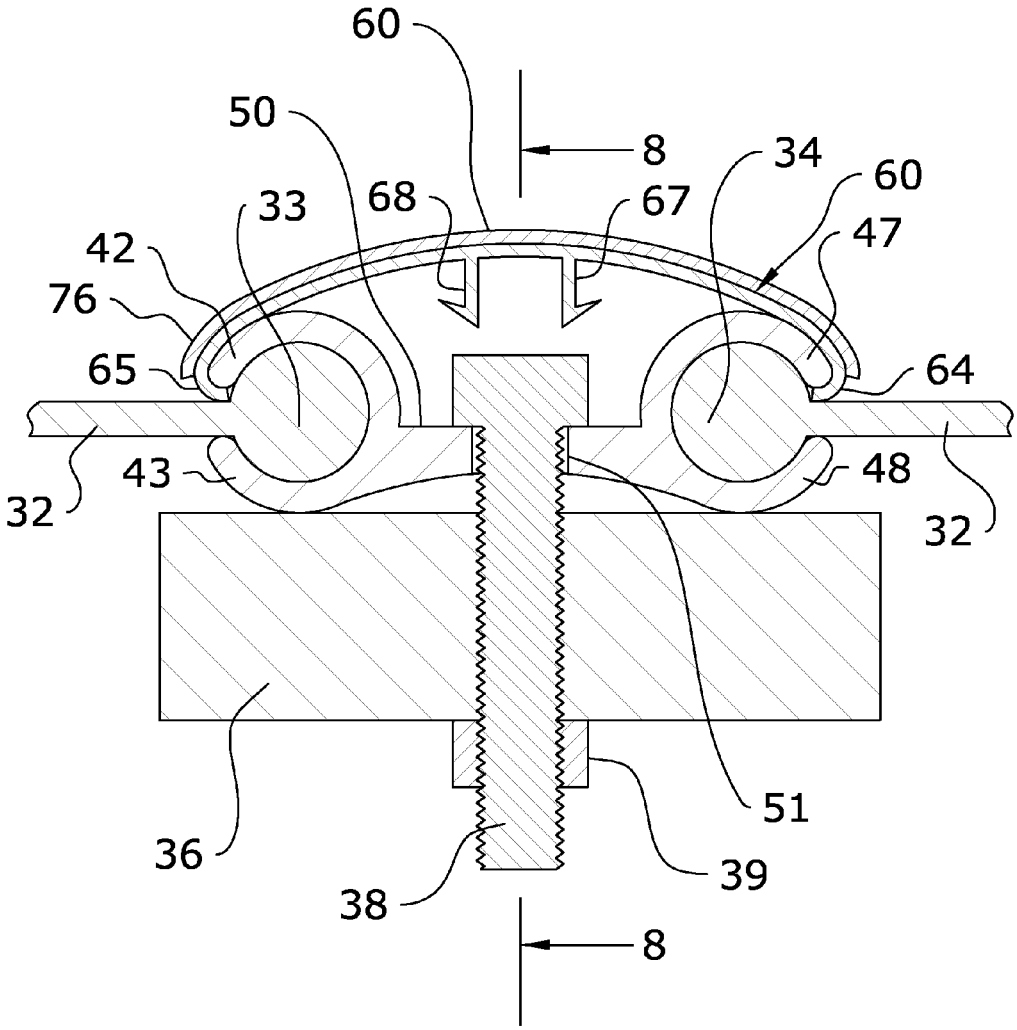
FIG. 7 is a sectional view taken along lines 7-7 of FIG. 4.
Figure 8:
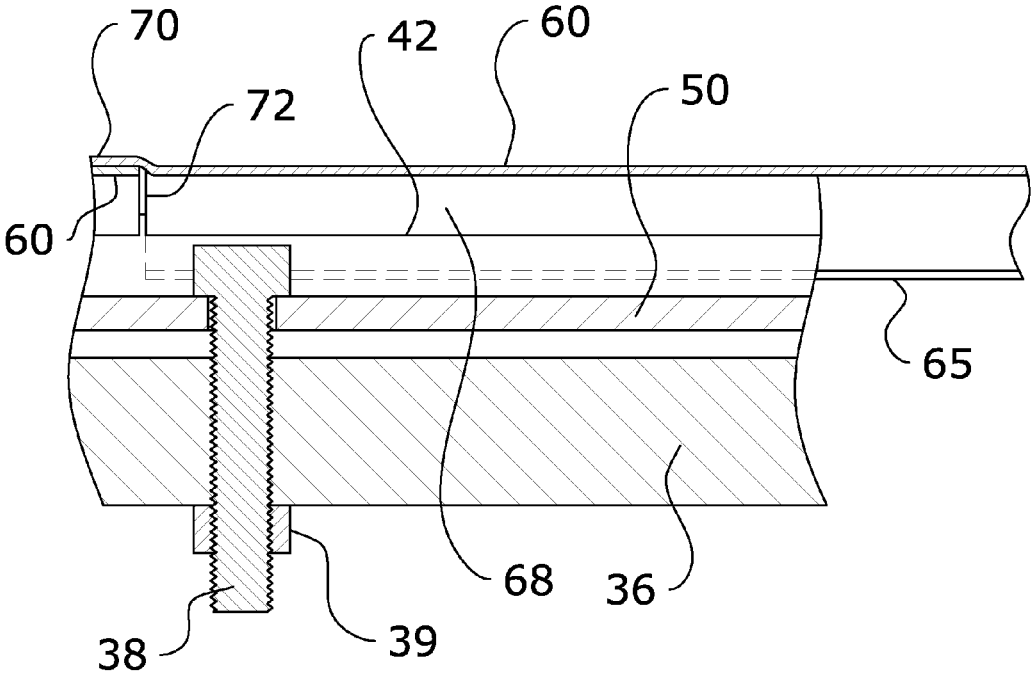
FIG. 8 is a sectional view taken along lines 8-8 of FIG. 7.

The overall building structure preferably includes a foundation 22, opposing end walls 23 and at least one door opening 24 as illustrated in FIG. 1 of the drawings. The roof structure 30 is preferably comprised of a plurality of trusses 36 that are arch shaped forming a curved roof structure 30. The trusses 36 are preferably substantially parallel to one another as is commonly used for trusses 36. The trusses 36 may be comprised of any type of truss configuration capable of supporting a roof structure 30. The trusses 36 include a plurality of apertures that receive the fasteners 38 that attach the connecting members 40 as illustrated in FIGS. 6 through 8 of the drawings.

C. Connecting Members.

Figure 2:
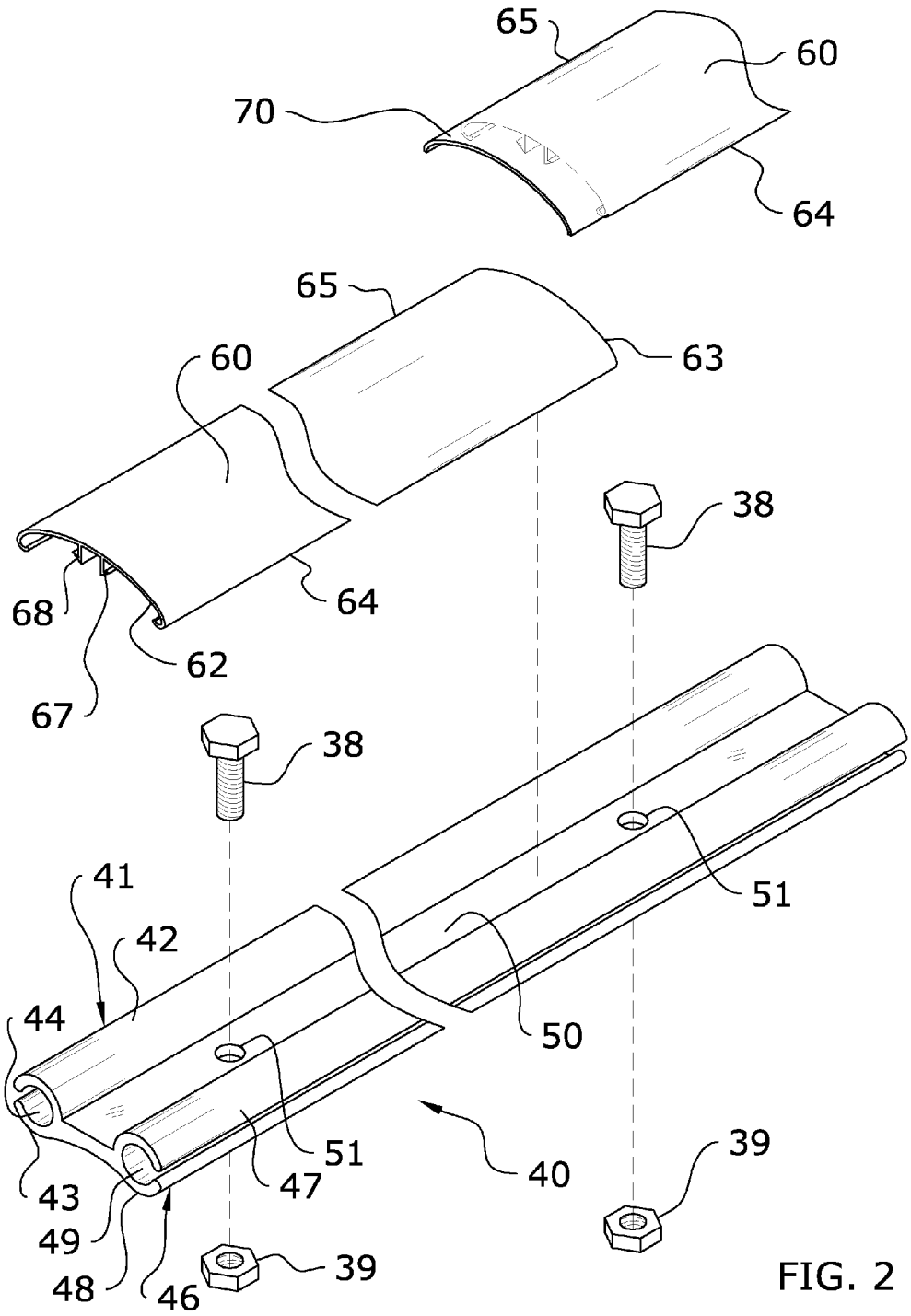
FIG. 2 is an exploded upper perspective view of the present invention.
Figure 3:
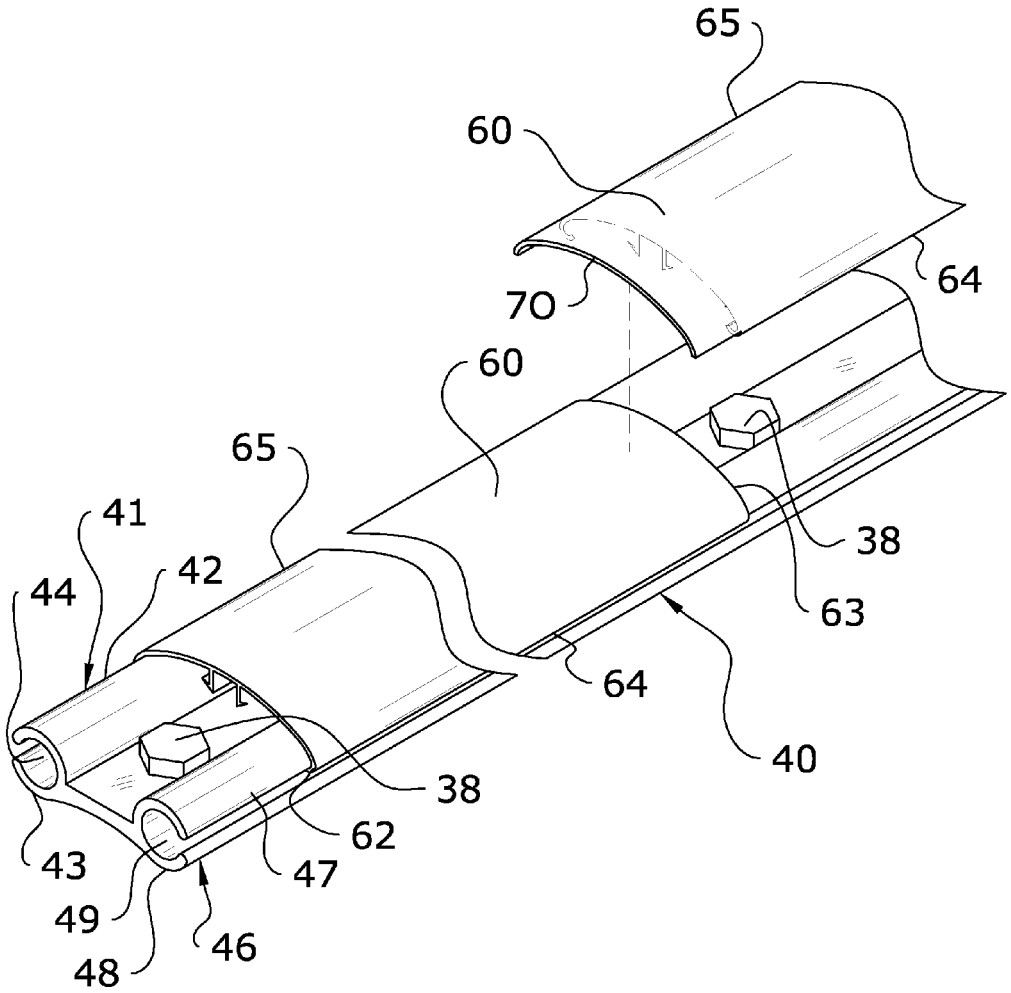
FIG. 3 is an upper perspective view illustrating the lower covering strip attached.
Figure 4:
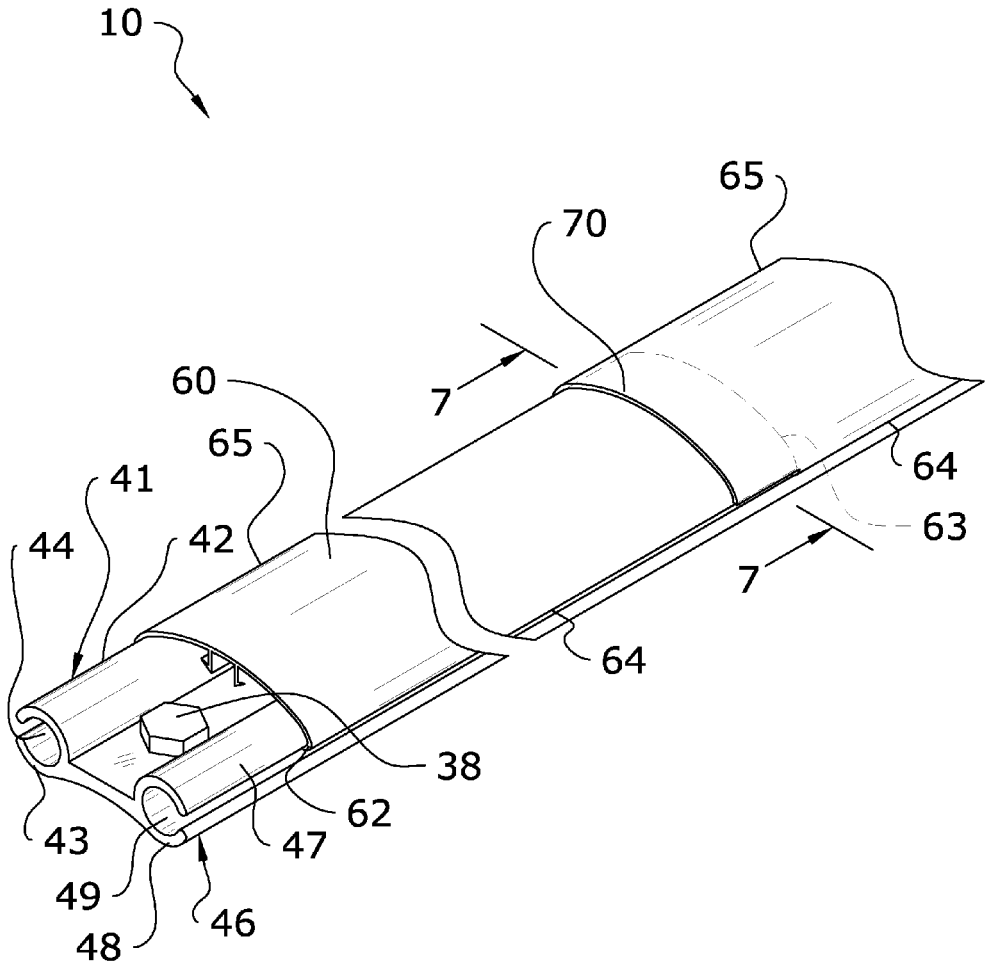
FIG. 4 is an upper perspective view illustrating the lower covering strip and the upper covering strip attached.
Figure 5:
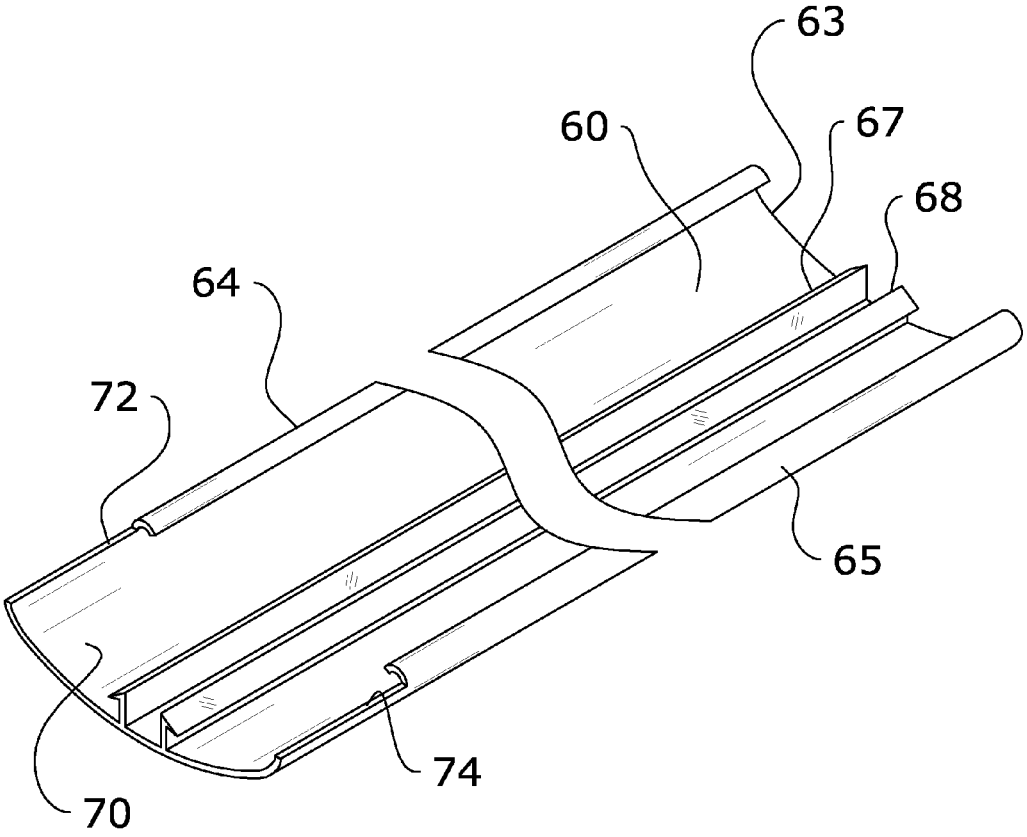
FIG. 5 is an upper perspective view of the underside of the covering strip.

A plurality of connecting members 40 are attached to the upper portion of the plurality of trusses 36 to support the fabric panels 32. The connecting members 40 each include a first connector 41 having a first keder channel 44 and a second connector 46 having a second keder channel 49 as illustrated in FIGS. 2 through 4 of the drawings. The connecting members 40 are comprised of an elongated structure and have a shape similar to the trusses 36 (e.g. curved). The connecting members 40 may have various lengths and widths to be utilized within various building structures.

The connecting members 40 each further include a center portion 50 between the first keder channel 44 and the second keder channel 49 that includes a plurality of openings 51 that receive threaded fasteners 38. The center portion 50 is preferably substantially flat as best illustrated in FIGS. 2 and 3 of the drawings. The threaded fasteners 38 (e.g. bolts) along with a corresponding number of securing members 39 (e.g. nuts) secure the connecting members 40 to the trusses 36 as illustrated in FIGS. 6 through 9 of the drawings. The openings 51 within the connecting members 40 correspond in location to the apertures within the trusses 36.

The connecting members 40 preferably include a first upper guide 42 and a first lower guide 43 defining the first connector 41 and the first keder channel 44 as further illustrated in FIGS. 2, 3, 4, 6, 7 and 8 of the drawings. The connecting members 40 further preferably include a second upper guide 47 and a second lower guide 48 defining the second connector 46 and the second keder channel 49 as further illustrated in FIGS. 2, 3, 4, 6, 7 and 8 of the drawings. The first upper guide 42 and the second upper guide 47

D. Fabric Panels.

At least one fabric panel includes a first keder 33 and a second keder on opposite sides thereof. The fabric panels 32 are comprised of an elongated pliable sheet material that is capable of forming the roof structure 30. The first keder 33 and the second keder are attached to opposite edges of the fabric panel as is commonly used in the keder building industry.

The fabric panels 32 may be comprised of any conventional type of keder style fabric panel. The fabric panels 32 may also be comprised of any type of material that is substantially impermeable to water, wind and the weather elements. The fabric panel is connected between the connecting members 40 with the first keder 33 retained within the first keder channel 44 and the second keder retained within the second keder channel 49 which are common within the keder building industry and illustrated in FIGS. 6 and 7 of the drawings.

E. Cap Members.

FIG. 1 illustrates a plurality of cap members 60 connected to the connecting members 40 to form the roof structure 30. The cap members 60 are comprised of an elongated structure and may have various lengths to accommodate various building structures. The cap members 60 are preferably slightly wider than the connecting members 40 to snugly fit over the connecting members 40 in a sealed manner as best illustrated in FIGS. 6 and 7 of the drawings. The cap members 60 are formed to the shape of the connecting members 40 and the trusses 36 (e.g. curved). The cap members 60 are preferably comprised of an extruded structure but may be constructed of other types of structures. The cap members 60 each are preferably comprised of a flattened C-shaped cross sectional shape as best illustrated in FIGS. 6 and 7 of the drawings. The C-shaped cross sectional shape provides for resiliency when attaching to the connecting members 40 and provides a curved outer surface to deflect water.

The cap members 60 are catchably and removably attached to the connecting members 40. It is preferable that the cap members 60 snap onto the outer edge portions of the connecting members 40 for easy installation and to form a weather tight seal between the cap members 60 and the connecting members 40 as illustrated in FIG. 7 of the drawings. It is preferable that the cap members 60 are not connected to the connecting members 40 with threaded fasteners 38 or any other type of fastener that would require an aperture to extend through the cap members 60 which could introduce water or other weather elements.

The cap members 60 each include a first edge 64 and a second edge 65 as illustrated in FIGS. 2, 3, 4 and 5 of the drawings. The first edge 64 and the second edge 65 are preferably inwardly curved as illustrated in FIG. 6 of the drawings. The first edge 64 and the second edge 65 catchably engage a first side and a second side of the connecting members 40 respectively as illustrated in FIG. 7 of the drawings. The first edge 64 and the second edge 65 catchably extend over the first upper guide 42 and the second upper guide 47 respectively in a catchable manner to prevent removable of the cap member 60 and to seal the cap member 60 along the length thereof with the cap member 60. The cap member 60 defines a weather tight interior cavity where the head of the fasteners 38 are as illustrated in FIG. 7 of the drawings.

At least one of the cap members 60 includes an overlapping end 70 that overlaps an end portion of another of the cap members 60 as illustrated in FIGS. 2, 3, 4, 7 and 8 of the drawings. The overlapping end 70 preferably does not catchably engage the cap members 60. The overlapping end 70 preferably includes a first cutout 72 and a second cutout 74 opposite of the first cutout 72 on the opposing sides thereof that allows the overlapping end 70 to be expanded upwardly slightly to accommodate the end of the overlapped connecting member 40 as illustrated in FIG. 8 of the drawings. The overlapping end 70 preferably extends outwardly at least 0.5 inches to sufficiently overlap the lower cap member 60.

As illustrated in FIGS. 3, 4, 6 and 7 of the drawings, the cap members 60 each preferably include at least one reinforcing member 67, 68 that extends substantially centrally along the length of the cap members 60. As illustrated in FIGS. 3, 4, 6 and 7, a first reinforcing member and a second reinforcing member may be utilized to strengthen the center of the cap members 60.

F. Operation of Preferred Embodiment.

In use, the trusses 36 are assembled to form the roof structure 30 and the connecting members 40 are attached to the trusses 36 with the fasteners 38 as illustrated in FIGS. 6, 7 and 8 of the drawings. The user then attaches the fabric panels 32 via the keder system between the connecting members 40 to form the fabric roof. After the fabric panels 32 are fully installed (or prior to the same), the cap members 60 are attached to the connecting members 40 to protect the fasteners 38 and the interior of the building from the exterior weather elements. It is preferable to attached the lowest most cap member 60 to the lowest side portion of the connecting member 40. This lowest most cap member 60 will not have an overlapping end 70 and instead will just have a first end 62 and a second end 63 having the same structures. After the lowest most cap member 60 is catchably secured to the connecting member 40, the user then attaches an overlapping cap member 60 wherein the overlapping end 70 of the overlapping cap member 60 overlaps a portion of the lowest most cap member 60 as illustrated in FIGS. 3 and 4 of the drawings. The end of the overlapping cap member 60 opposite of the overlapping end 70 is preferably comprised of a non-overlapping end 70 (see the second end 63 of FIG. 5 for an example). This process continues until the user reaches the top of the roof structure 30 and then they continue to the other side of the roof structure 30 starting at the lowest most portion thereof. The top cap member 60 preferably has two opposing overlapping ends 70 to overlap the next cap members 60 on both sides of the roof structure 30. It can be appreciated that the overlapping end 70 must face at least slightly downward to prevent water and other weather elements from coming underneath the cap member 60.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A weatherproof fabric-covered building system, comprising:

a plurality of connecting members, wherein said connecting members each include a first connector having a first keder channel and a second connector having a second keder channel;

at least one fabric panel having a first keder and a second keder, wherein said fabric panel is connected between said connecting members with said first keder retained within said first keder channel and said second keder retained within said second keder channel; and a plurality of cap members connected to said connecting members, wherein said cap members each include a first edge and a second edge, wherein said first edge and said second edge catchably engage a first side and a second side of said connecting members respectively.

2. The weatherproof fabric-covered building system of claim 1, wherein said fabric panel is comprised of a substantially impermeable material.

3. The weatherproof fabric-covered building system of claim 1, wherein said cap members are catchably attached to said connecting members.

4. The weatherproof fabric-covered building system of claim 3, wherein said cap members are removably attached to said connecting members.

5. The weatherproof fabric-covered building system of claim 1, wherein said cap members are not connected to said connecting members with threaded fasteners.

6. The weatherproof fabric-covered building system of claim 1, wherein said cap members and said connecting members are curved.

7. The weatherproof fabric-covered building system of claim 1, wherein said connecting members each include a center portion between said first keder channel and said second keder channel, wherein said center portion includes a plurality of openings that receive threaded fasteners to secure said connecting members to a truss.

8. The weatherproof fabric-covered building system of claim 1, wherein at least one of said cap members includes an overlapping end that overlaps an end portion of another of said cap members.

9. The weatherproof fabric-covered building system of claim 1, wherein said overlapping end does not catchably engage said connecting members.

10. The weatherproof fabric-covered building system of claim 1, wherein said cap members have a flattened C-shaped cross sectional shape.

11. The weatherproof fabric-covered building system of claim 1, wherein said connecting members include a first upper guide and a first lower guide defining said first keder channel, and a second upper guide and a second lower guide defining said second keder channel, wherein said cap members catchably engage said first upper guide and said second upper guide.

12. The weatherproof fabric-covered building system of claim 1, wherein said cap members each include at least one reinforcing member.

13. The weatherproof fabric-covered building system of claim 1, wherein said cap members are comprised of an extruded structure.

14. The weatherproof fabric-covered building system of claim 1, wherein said first edge and said second edge are each comprised of a C-shape.

15. A weatherproof fabric-covered building system, comprising:

a plurality of trusses;

a plurality of connecting members attached to said plurality of trusses, wherein said connecting members each include a first connector having a first keder channel and a second connector having a second keder channel;

at least one fabric panel having a first keder and a second keder, wherein said fabric panel is connected between said connecting members with said first keder retained within said first keder channel and said second keder retained within said second keder channel;

wherein said fabric panel is comprised of a substantially impermeable material; and a plurality of cap members connected to said connecting members;

wherein said cap members are catchably and removably attached to said connecting members;

wherein said cap members are not connected to said connecting members with threaded fasteners;

wherein said connecting members each include a center portion between said first keder channel and said second keder channel, wherein said center portion includes a plurality of openings that receive threaded fasteners, wherein said threaded fasteners secure said connecting members to said trusses;

wherein at least one of said cap members includes an overlapping end that overlaps an end portion of another of said cap members, wherein said overlapping end does not catchably engage said connecting members.

16. The weatherproof fabric-covered building system of claim 15, wherein said trusses are arch shaped, and wherein said cap members and said connecting members are curved corresponding to said trusses.

17. The weatherproof fabric-covered building system of claim 15, wherein said cap members each include a first edge and a second edge, wherein said first edge and said second edge catchably engage a first side and a second side of said connecting members respectively.

18. The weatherproof fabric-covered building system of claim 15, wherein said connecting members include a first upper guide and a first lower guide defining said first keder channel, and a second upper guide and a second lower guide defining said second keder channel, wherein said cap members catchably engage said first upper guide and said second upper guide.

19. A weatherproof fabric-covered building system, comprising:

a plurality of connecting members, wherein said connecting members each include a first connector having a first keder channel and a second connector having a second keder channel;

at least one fabric panel having a first keder and a second keder, wherein said fabric panel is connected between said connecting members with said first keder retained within said first keder channel and said second keder retained within said second keder channel; and a plurality of cap members connected to said connecting members, wherein at least one of said cap members includes an overlapping end that overlaps an end portion of another of said cap members, wherein said overlapping end includes a first cutout and a second cutout opposite of said first cutout.

* * * * *